US006286403B1

(12) United States Patent
Rosenthal et al.

(10) Patent No.: US 6,286,403 B1
(45) Date of Patent: Sep. 11, 2001

(54) CUTTING MACHINE

(75) Inventors: Ben J. Rosenthal, Winnetka; Gregory Starr, Buffalo Grove; Michael L. Rosenthal, Glencoe; Valery Lashoff, Niles, all of IL (US)

(73) Assignee: Rosenthal Manufacturing Co., Inc., Northbrook, IL (US)

( * ) Notice: Subject to any disclaimer, the term of this patent is extended or adjusted under 35 U.S.C. 154(b) by 0 days.

(21) Appl. No.: 09/298,548

(22) Filed: Apr. 22, 1999

(51) Int. Cl.[7] ..... B26D 5/20; B26D 1/18

(52) U.S. Cl. ..... 83/215; 83/152; 83/486.1; 83/487; 83/508; 83/590; 83/614

(58) Field of Search ..... 83/215, 151, 152, 83/644, 578, 486.1, 614, 639.1, 590, 508, 487, 486, 636, 100

(56) References Cited

U.S. PATENT DOCUMENTS

| | | | | |
|---|---|---|---|---|
| 519,682 | | 5/1894 | Randall . | |
| 931,220 | | 8/1909 | Roesch et al. . | |
| 1,888,744 | | 11/1932 | Shook . | |
| 1,888,754 | | 11/1932 | Alexander et al. . | |
| 3,205,743 | | 9/1965 | Langenberg et al. | 83/215 |
| 3,701,301 | | 10/1972 | Gudmestad | 83/151 |
| 3,821,915 | * | 7/1974 | Larrable | 83/649 |
| 4,034,634 | | 7/1977 | Arbter | 83/18 |
| 4,046,044 | * | 9/1977 | Paterson et al. | 83/508 |
| 4,152,962 | * | 5/1979 | Hendrischk | 83/508 |
| 4,361,957 | * | 12/1982 | Krotz et al. | 83/100 |
| 4,455,905 | * | 6/1984 | Raymond | 83/649 |
| 4,541,405 | * | 9/1985 | Schlough | 83/636 |
| 4,555,967 | * | 12/1985 | Jumel | 83/106 |
| 4,576,076 | | 3/1986 | Pyle | 83/471.3 |
| 4,665,787 | * | 5/1987 | Arnold et al. | 83/508 |
| 4,754,674 | * | 7/1988 | Periman | 83/649 |
| 4,781,094 | | 11/1988 | Moretti | 83/488 |
| 4,864,906 | * | 9/1989 | Hall | 83/614 |
| 4,907,014 | * | 3/1990 | Tzeng et al. | 83/614 |
| 5,168,786 | | 12/1992 | Huggins et al. | 83/308 |
| 5,307,716 | * | 5/1994 | Onishi et al. | 83/508 |
| 5,611,253 | * | 3/1997 | Saito et al. | 83/383 |
| 5,647,261 | * | 7/1997 | Wierenga | 83/649 |
| 5,845,554 | * | 12/1998 | Kozyrski | 83/614 |
| 5,868,056 | * | 2/1999 | Pfarr et al. | 83/646 |

* cited by examiner

*Primary Examiner*—M. Rachuba
(74) *Attorney, Agent, or Firm*—Olson & Hierl, Ltd.

(57) ABSTRACT

A cutting machine for cutting long lengths of sheet material, roll material, or web material into predetermined or discrete lengths comprises a frame having a stationary blade extending transversely of the frame and a carriage movable transversely of the material to be cut having a movable blade thereon that cooperates with the stationary blade to cut material. The movable blade is mounted on the carriage so that it can be canted at an angle with respect to the stationary blade during transverse movement of the carriage in one direction and can be oppositely canted at an angle with respect to the stationary blade during movement of the carriage in the opposite direction. In one embodiment, a toggle mechanism is used to cant the movable blade. In a second embodiment, a fluid cylinder is used to cant the movable blade.

27 Claims, 6 Drawing Sheets

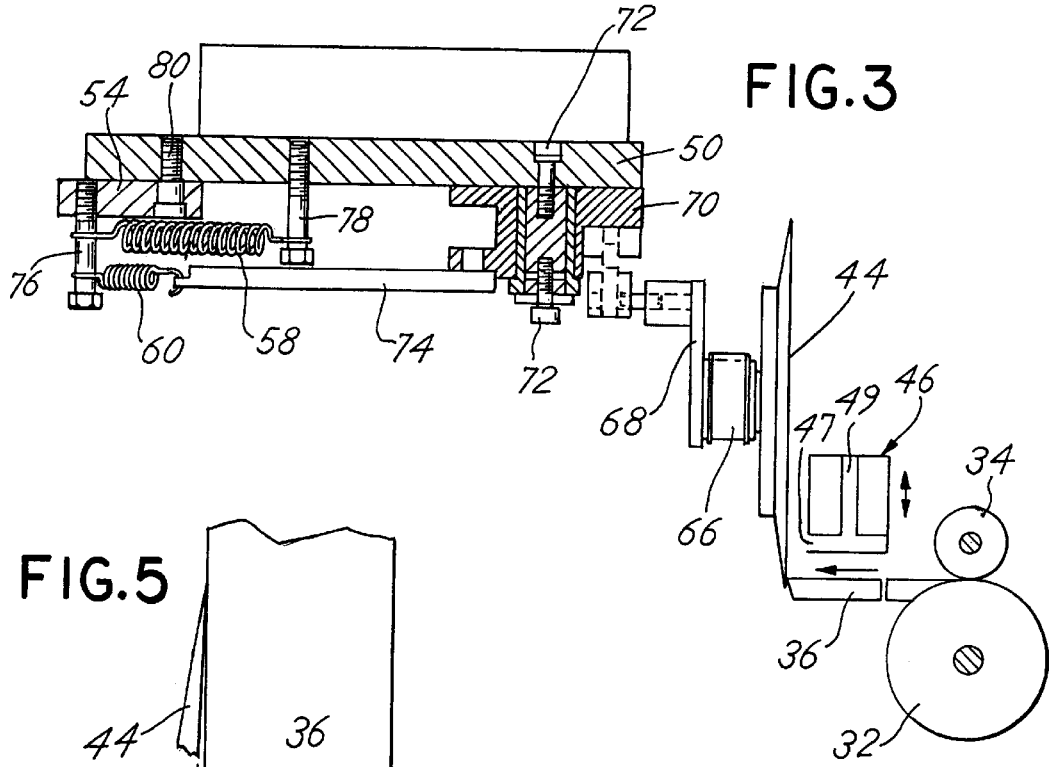
FIG.3
FIG.5
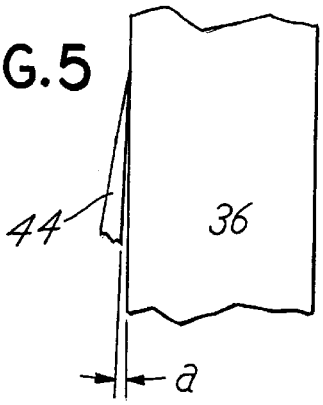
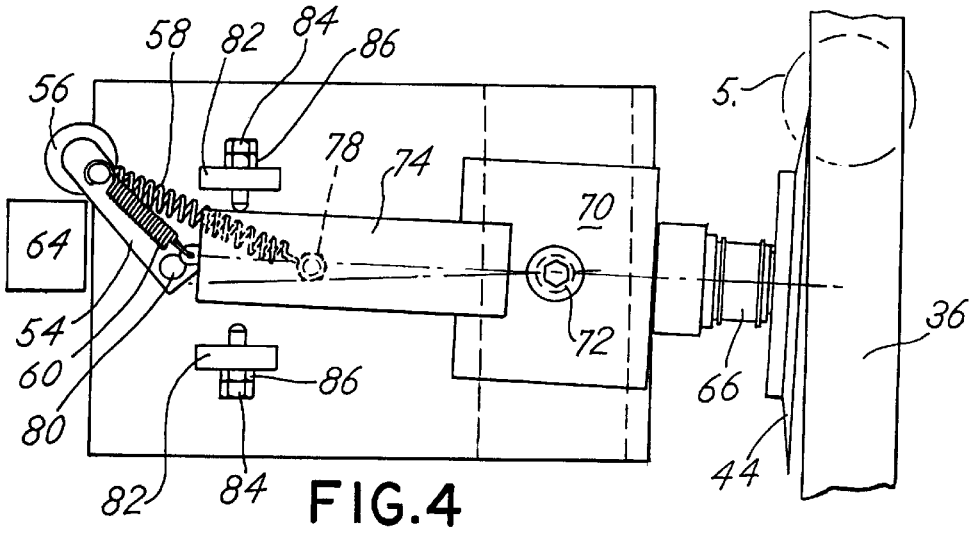
FIG.4

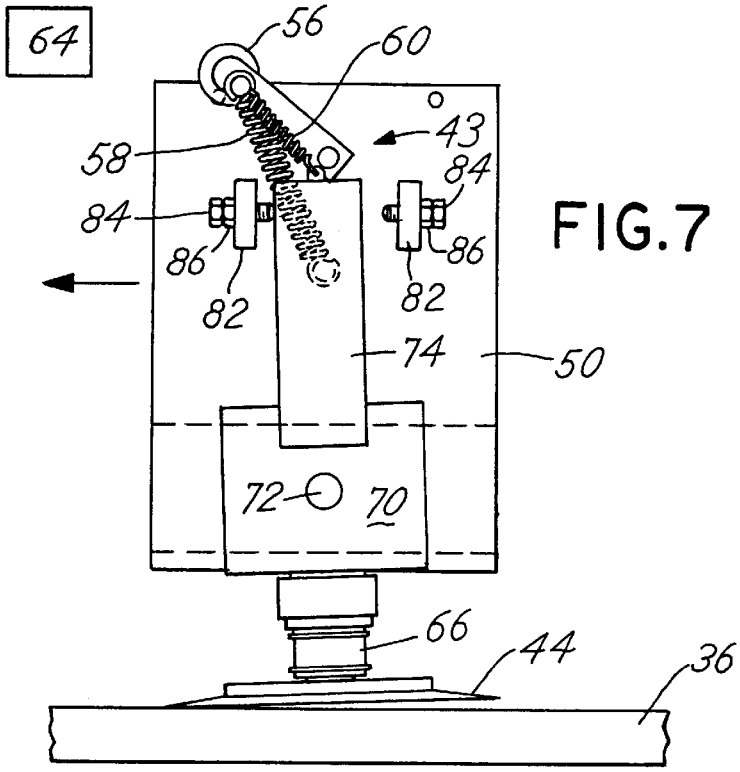
FIG.7
FIG.8
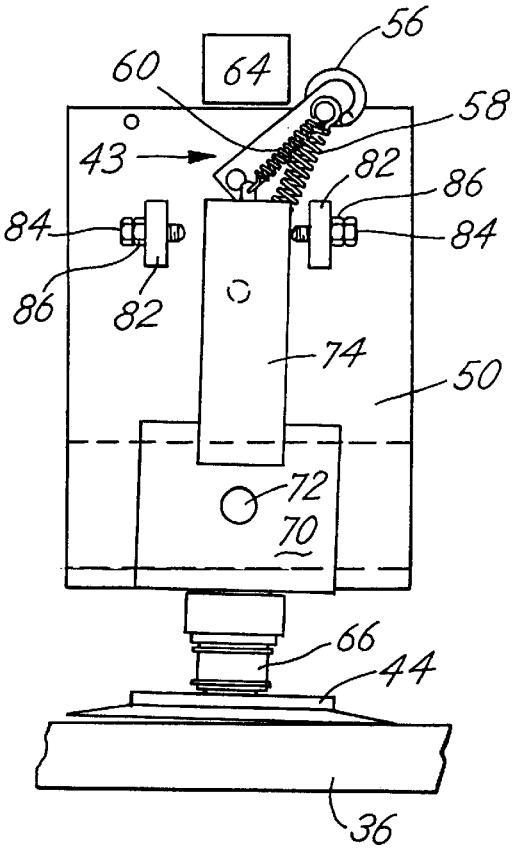
FIG.6
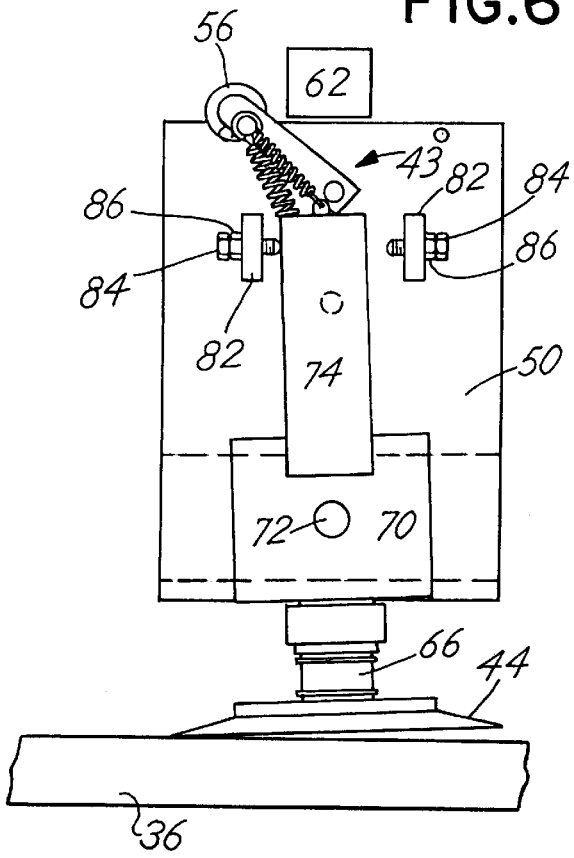

FIG.9
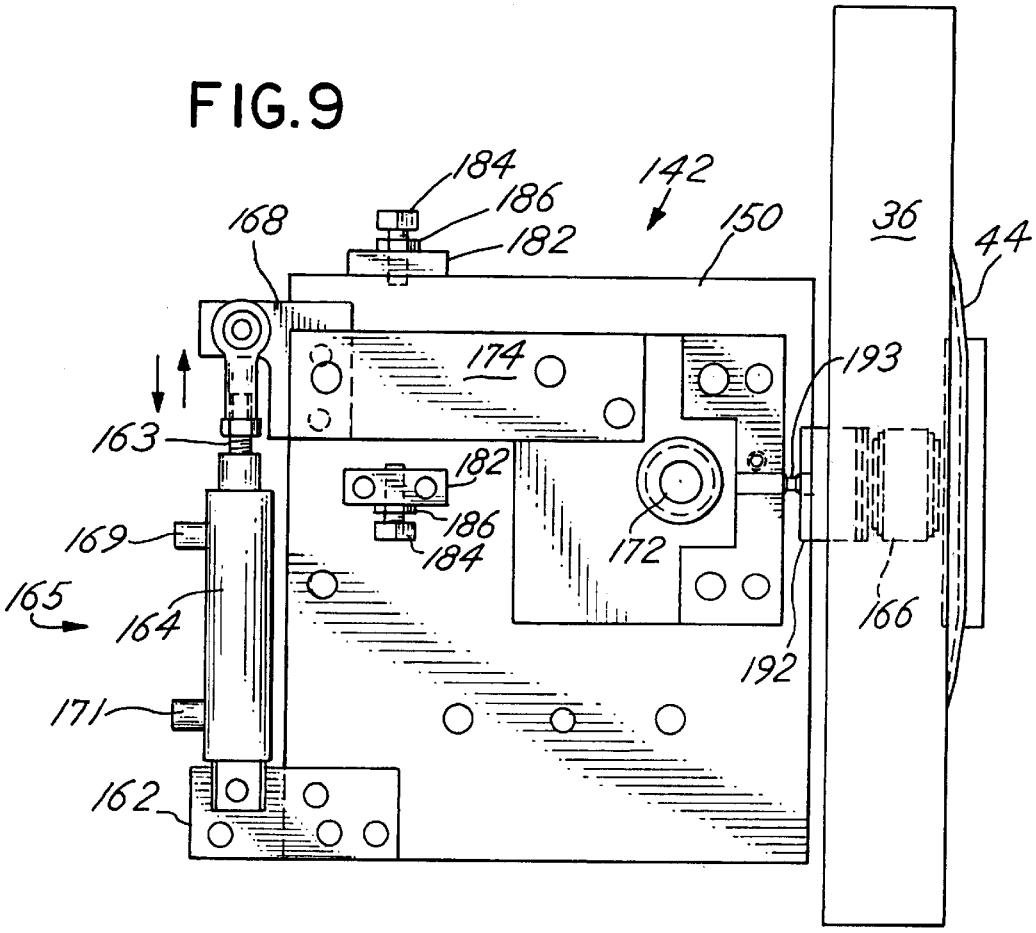
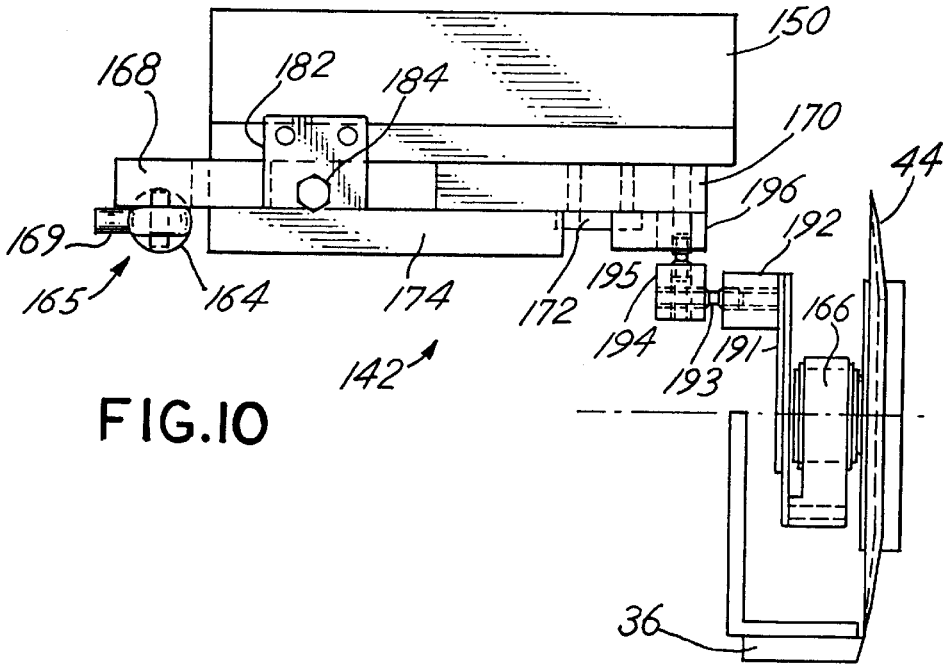
FIG.10

CUTTING MACHINE

BACKGROUND OF THE INVENTION

This invention pertains to a cutting machine and, more particularly, to a cutting machine having a rotary cutting blade frictionally cooperating with a stationary blade disposed transversely of the frame of the cutting machine, the rotary cutting blade being canted in a first direction during forward traverse of the rotary cutting blade across the material to be cut, and being canted in the opposite direction during reverse transverse movement of the cutting blade across the material to be cut.

Cutting machines are known wherein a rotary blade cooperates with a stationary blade for cutting material from a supply roll into sheets of predetermined length. Normally, in such cutting machine, the rotary blade is parallel to the cutting edge of the stationary blade. In another cutting machine used for shear slitting, a round bottom blade is mounted in fixed canted relationship to a top blade. The blades can move relative to one another in one direction for cutting material, but not in the reverse direction.

In order to speed operation of the cutting machine and enhance the cutting action, it is contemplated to provide a cutting machine for material of various types that includes a rotary cutting blade that may be canted by different means in order to accomplish the desired cutting results. In one embodiment, a fluid cylinder is contemplated to cant the rotary cutting blade at each end of transverse travel across the material to be cut. In a second embodiment, a toggle mechanism is contemplated to cant the rotary cutting blade at each end of transverse travel across the material to be cut.

In cutting certain materials, such as copper film, shards or particles are formed which tend to contaminate and perhaps scratch the surface of adjacent sheets. It is desired that the cut be as clean as possible and that there be no shards.

An object of the present invention is to provide a cutting machine for cutting material from long sheets, rolls or webs or the like into sheets of discrete length by cutting transversely of the material to be cut in both a first direction and a reverse direction, with the cutting machine including a movable blade and a stationary blade, with the movable blade canted with respect to the stationary blade during movement is said first direction and said reverse direction.

Another object of the present invention is to provide a cutting machine with a toggle mechanism to cant the rotary cutting blade at the end of transverse movement in each direction of operation in order to enable cutting in both directions transverse of the material to be cut.

Yet another object of the present invention is to provide a cutting machine with a fluid cylinder to cant the rotary cutting blade at the end of transverse movement in each direction of operation in order to enable cutting in both directions transverse of the material to be cut.

Another object of the present invention is to provide a cutting machine for cutting material into suction manifold adjacent the cutting region in order to draw particles of cut material and dust into the suction manifold and remove them from the cutting region between the rotary cutting blade and the stationary blade.

Other objects and advantages of the present invention will be made more apparent in the description which follows.

SUMMARY OF THE INVENTION

The present invention pertains to a cutting machine for cutting material from long lengths, rolls, webs, or the like into sheet material which includes a stationary blade disposed transversely of the material to be cut and a movable blade cooperating with the stationary blade to cut material, the movable blade being canted in one direction during forward traverse of the carriage carrying the movable blade and the movable blade being canted in the opposite direction during reverse traverse movement of the carriage.

In another aspect, this invention pertains to a method of cutting long lengths of sheet material, rolls or webs of material or the like into discrete lengths utilizing a stationary blade extending transverse of the material to be cut and a movable blade cooperating with the stationary blade to cut material, comprising the steps of canting the movable blade in one direction during forward traverse of the movable blade across the material to be cut and canting the blade in the opposite direction during reverse traverse of the movable blade across the material to be cut, whereby, the movable blade makes essentially point contact with the stationary blade during cutting operation and cutting of material is effected in both forward and reverse traverse of the movable blade with respect to the material to be cut.

BRIEF DESCRIPTION OF THE DRAWINGS

There is shown in the attached drawing presently preferred embodiments of the present invention, wherein like numerals in the various views refer to like elements; and wherein:

FIG. 3 is an enlarged view of a portion of the cutting machine, partially in cross-section, illustrating the cooperation of the movable blade and the stationary blade and the suction means for removing particles of cut material and dust from the cutting region between the movable blade and the stationary blade;

FIG. 4 is a bottom view of the portion of the cutting machine shown in FIG. 3;

FIG. 5 is a detail view illustrating the cooperation between the canted movable blade and the stationary blade;

FIG. 6 is a detail view illustrating the carriage for the movable blade in the resting position at one side of the cutting machine adjacent a stationary cam;

FIG. 7 is a detail view illustrating the carriage for the movable blade as it approaches the stationary cam at the opposite side from that shown in FIG. 6;

FIG. 8 is a detail view illustrating the carriage for the movable blade just after engaging the stationary cam and reversing a lever of the toggle mechanism to cant the movable blade so as to cut in the opposite direction as shown in FIGS. 6 and 7;

FIG. 9 is a bottom view of the base of the second embodiment of the present invention utilizing a fluid cylinder to cant the movable blade;

FIG. 10 is an elevation view of the base of the second embodiment of the present invention utilizing a fluid cylinder to cant the movable blade.

DETAILED DESCRIPTION OF THE PRESENT INVENTION

Figure 1:
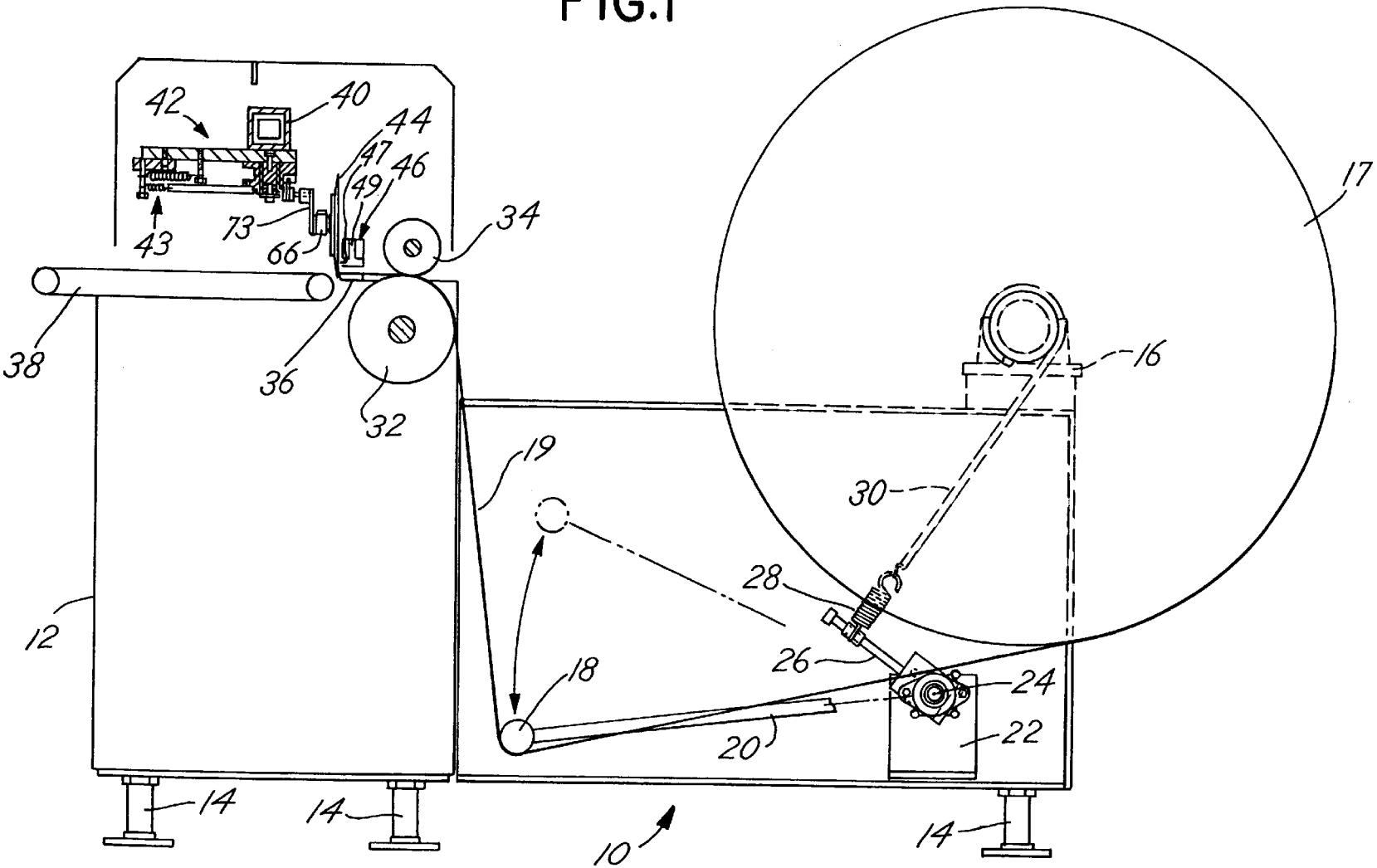
FIG. 1 shows a side view of an embodiment of the cutting machine for cutting material into sheet material of discrete length embodying the present invention.

There is shown in FIGS. 1–8 a first embodiment of the cutting machine 10 of the present invention. The cutting machine 10 includes a frame 12 having adjustable stabilizing legs 14 for appropriately supporting the frame 12 on a surface. The frame 12 has mounted thereon spaced journals 16 for carrying a roll 17 of material to be cut. The material can be metal, such as copper, fiberglass, prepreg or the like. Further, as noted above, the material can be in a form other than a roll, for example, elongated sheets or web material. In the embodiment of FIG. 1, a dancer roll 18 is carried on rods 20 that are pivoted at their ends in a journal block 22. A shaft 24 is carried in the journal blocks 22. Rod 26 is secured to the shaft 24. The spring 28 is connected at one end to the rod 26 and at the other end to a member secured to the journal 16 so as to bias the dancer roll 18 upwardly as viewed in FIG. 1. This arrangement will apply a proper tension to the material 19 which is fed from the roll 17 to the feed roll 32 and the pinch roll 34 on the frame 12. The material 19 will be fed over the stationary cutting bar or blade 36 onto the output conveyor 38.

Supported transversely of the frame 12 is a tubular cross beam 40. Movable on the cross beam 40 is a carriage assembly 42 which carries a movable round blade 44 that is adapted to cooperate with the stationary blade, 36 to cut material 19 from the roll 17 into discrete sheets.

The carriage assembly 42 includes a toggle mechanism 43 to cant the movable blade 44 with respect to the stationary blade 36 at the end of each traverse of the carriage assembly 42 across the frame 12, as will be described more fully hereinafter.

A clamping mechanism 46 is provided on the frame 12 that cooperates with the stationary blade 36 in order to hold the material to be cut in the cutting position.

Figure 2:
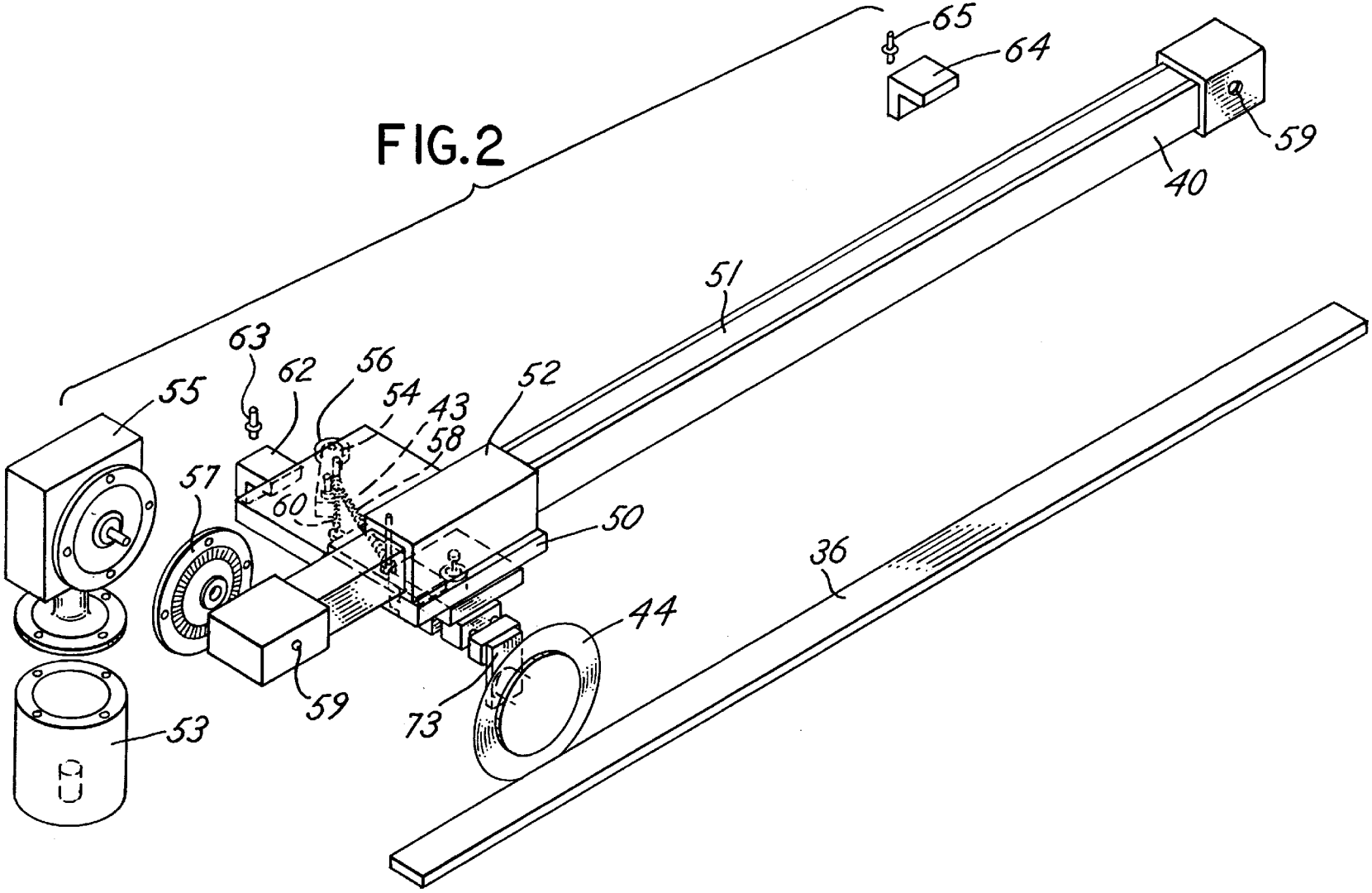
FIG. 2 is a perspective schematic view illustrating the stationary cam limit means that cooperate with the toggle mechanism for canting the movable blade with respect to the stationary blade at the ends of transverse movement.

Turning to FIG. 2, there is shown the cross beam 40 for supporting the carriage assembly 42 for movement transversely of the frame 12. The movable blade 44 is rotatably carried on the carriage assembly 42 and frictionally cooperates with the stationary blade 36 to cut material. The carriage assembly 42 includes a base 50 to which is secured a tubular housing 52 that embraces the cross beam 40 and is carried thereon. Pivoted on the base 50 is a lever 54 having a roller 56 rotatably carried on the end thereof. Biasing the lever 54 are a first spring 58 and a second spring 60 as will be described more fully hereinafter. The lever cooperates with a stationary cam 62 carried on the left side of the frame 12 and a stationary cam 64 on the right side of the frame 12 in order to cant the movable blade 44 with respect to the stationary blade 36.

The tubular housing 52 is moved by suitable actuating means, for example, as shown, a cog belt 51 movably carried on the cross beam 40 and driven at one end by a cut motor 53 operatively connected to a gear reducer 55 that is in turn connected to a flange 57 connected to a pulley shaft 59 upon which the cog belt 51 travels.

There is a like pulley shaft 59 secured at the other end of the cross beam 40 for supporting the cog belt 51.

Carried on the frame 12 proximate each end of travel of the carriage assembly 42 is a proximity limit switch 63, 65 for detecting when the carriage assembly 42 has reached the desired limit of movement.

With reference to FIGS. 3–8, the structure and operation of the toggle mechanism 43 for selectively canting the movable blade 44 at each end of traverse across the frame 12 will be more fully described. Material from the roll 17 is fed between the feed roll 32 and the pinch roll 34. The material will be clamped by the clamping mechanism 46 that is actuated toward and away from the stationary blade 36 by a suitable mechanism, for example, a fluid cylinder or a mechanical rack arrangement. The clamping mechanism 46 preferably is provided with an opening 47 in the form of an elongated slot positioned closely adjacent the cutting region between the movable blade 44 and the stationary blade 36. The clamping mechanism 46 includes a chamber 49 that communicates with the elongated slot or opening 47 and is connected to a source of suction (not shown) to create suction at the opening 47. The elongated slot or opening 47 and the chamber 49 provide suction means to draw any shards from cutting or any dirt or dust into the clamping mechanism 46 and away from the cutting region.

The movable blade 44 is round and is rotatably carried on the carriage assembly 42. The blade 44 frictionally cooperates with the stationary blade 36 in order to cut material. The movable blade 44 is joined to journal 66 that is supported on spring 68 arm that depends from a bracket or pivot block 70 that is suitably secured to the base 50 by screws 72. The spring arm 68 is in the form of a leaf spring for biasing the movable blade 44, which is rotably carried on the journal 66, against the stationary blade 36.

Rigidly fixed to the pivot block 70 is a main lever 74. Spring 60 is connected at one end to the lever 74 and at the other end to the depending post 76 on lever 54. The spring 58 is connected at one end to the post 78 depending from the base 50 and at the other end to the post 76. As clearly seen in FIGS. 3 and 4, the lever 54 pivots on the post 80 that depends from the base 50. The springs 58 and 60 are arranged in an overcenter arrangement as will be shortly be explained more fully.

An adjustable stop means is provided at each side of the lever 74 to limit the movement thereof. Each adjustable stop comprises a block 82 secured to the base 50 and a screw 84 threaded in an opening in the block 82 and extending through the block on both sides thereof. The screw 84 can be rotated to a desired adjusted position and then locked in place by the lock nut 86. The adjustable stop on the opposite side of the lever 74 is constructed in the same manner and is identified with the same numerals. Resilient bumpers can be positioned over the inner ends of the screws 84 to cushion the blow when the lever 74 is moved from one cant position to the other.

FIG. 5 shows the cant of the movable blade 44 with respect to the stationary blade 36. The angle of cant a is small, on the order of 1 to 10 degrees, depending upon the application.

Turning to FIGS. 6–8, the operation of the toggle mechanism will be described. FIG. 6 illustrates the start position of the base 50 with the toggle mechanism 43 thereon. The roller 56 on the lever 54 is adjacent the stationary cam 62. Spring 60 has pivoted the main lever 74 in order to cant the movable blade 44 as shown in FIG. 6. The main lever 74 contacts the adjustable stop 84.

FIG. 7 shows the base 50 as it approaches the stationary cam 64 at the opposite side of the frame from the stationary cam 62. Shortly, the roller 56 on the lever 54 will contact the stationary cam 64. The spring 60 will pull the lever 54 over center.

As seen in FIG. 8, the lever 54 has just been moved over center. The spring 58 will urge the lever 74 to the position shown and the movable blade 44 will be canted in the opposite direction from that shown in FIGS. 6 and 7 preparatory to movement of the carriage and the base 50 carried thereon in the opposite direction. The movable blade 44 will make essentially point contact with the stationary blade 36 during both directions of traverse across the frame.

Figure 11:
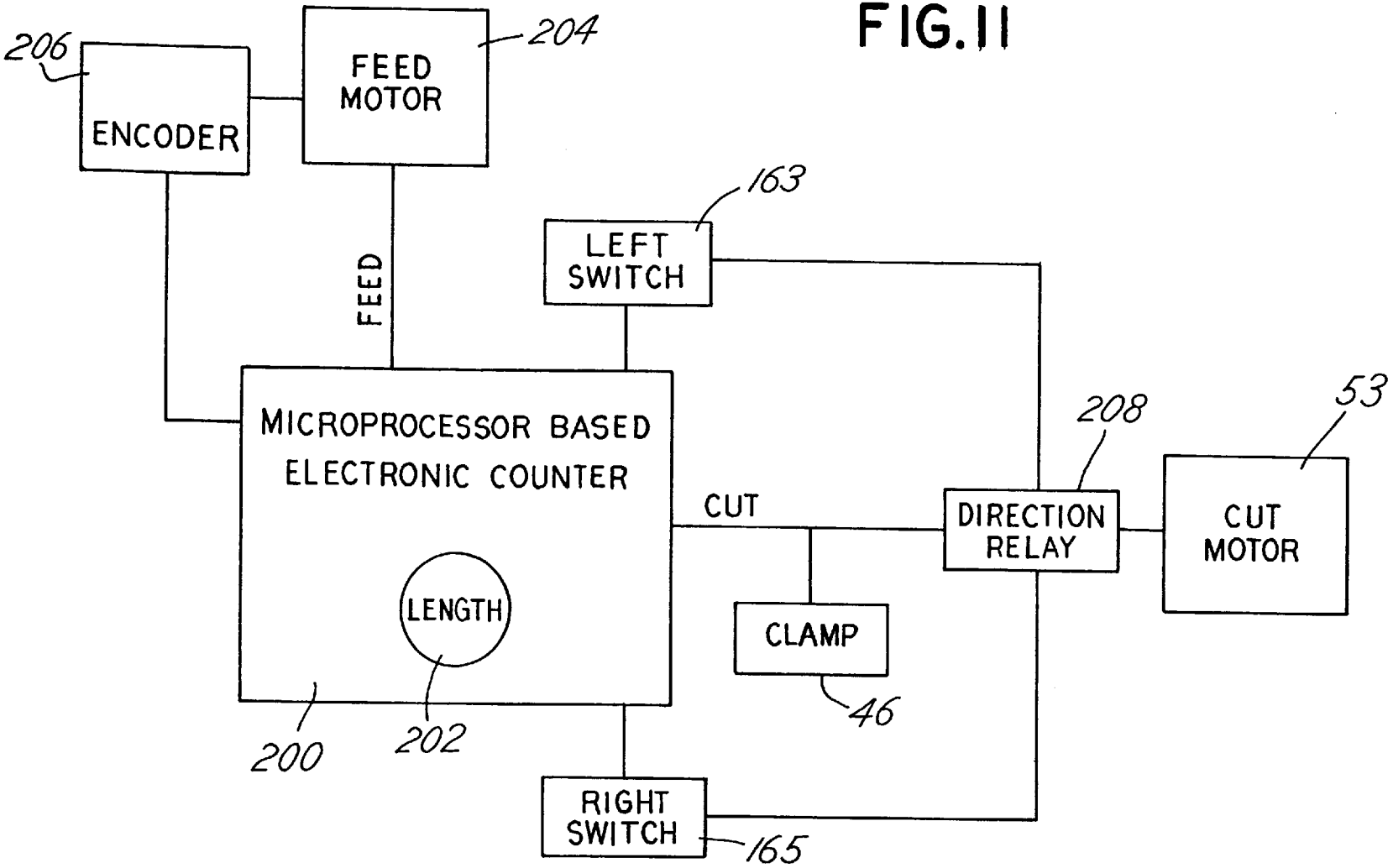
FIG. 11 is an operational schematic of the second embodiment.

There is shown in FIGS. 9–11 a second embodiment of the present invention, wherein the movable blade 44 is canted by a fluid cylinder rather than by a toggle mechanism. Referring to FIGS. 9 and 10, the base 150 is like the base 50. Lever 174 pivots on the pivot pin 172 on base 150. Secured to the base 150 is a bracket 162 that anchors an end of the fluid cylinder 164 of the fluid cylinder means 165. An actuating rod 163 moves out and in from the fluid cylinder 164, as indicated by the arrows in FIG. 9. The outlets 169 and 171 from the fluid cylinder 164 are connected to a suitable source of pressure, for example, an air compressor (not shown) in order to actuate the actuating rod 163 in or out from the fluid cylinder 164. It will be apparent to persons skilled in the art that the fluid cylinder means may be hydraulically powered rather than pneumatically powered. The actuating rod 163 is secured to the bracket 168 on the lever 174 for selectively pivoting the lever 174 on the base 150 to cant the movable blade 44 with respect to the stationary blade 36.

An adjustable stop means is provided at each side of the lever 174 to limit the movement thereof. Each adjustable stop comprises a block 182 secured to the base 150 and a screw 184 threaded in an opening in the block 182 and extending through the block on both sides thereof. The screw 184 can be rotated to a desired adjusted position and then locked in place by the lock nut 186. The adjustable stop on the opposite side of the lever 174 is constructed in the same manner and includes screw 184', block 182' and lock nut 186'.

The journal 166 for rotatably supporting the movable blade 44 may incorporate a flat power cylinder operable axially in order to apply a force to urge the movable blade 44 against the stationary blade 36 in normal operation. The face of the stationary blade 36 facing the movable blade is angled, as shown in FIG. 10 so as to provide minimum contact between the blades 36 and 44.

The journal 166 is supported on an arm 191 that depends from a block 192. Block 192 is adjustably connected to the block 194 by a threaded member 193 in order to provide for adjustment along the longitudinal axis of the threaded member 193. The block 194 is adjustably connected to the block 196 that is secured to the pivot block 170 by a threaded member 195 in order to provide for adjustment along the longitudinal axis of the member 195. This adjustment arrangement provides both x and y axis adjustment so as to position the movable blade 44 with respect to the stationary blade 36. Other adjustment means could be employed to accomplish the desired purposes.

Turning to FIG. 11, there is shown an operational schematic of the embodiment of FIGS. 9 and 10. The operating system includes a microprocessor based electronic counter 200 having a length button 202 thereon which can be pressed to initiate and terminate operation of the cutting machine. When the length button 202 is pressed to initiate operation, a signal is sent to the feed motor 204 to begin the feed of material. Signals corresponding to the advance of the material are sent to the encoder 206. When a predetermined number of signals are counted by the encoder 206, which correspond to the desired discrete length desired, a signal is sent to the electronic counter 200 to terminate operation of the feed motor 204 and initiate operation of the clamp mechanism 46 to clamp material to be cut against the stationary blade 36. At the same time a signal is sent to the direction relay 208. The direction relay 208 is in circuit with a left limit switch 163 and the right limit switch 165. When the left limit switch 163 is closed, the cut motor 53 will be actuated to move the carriage assembly 142 so as to cut material. When the carriage assembly 142 reaches the stationary cam at the right side of the frame, the right limit switch 165 will be closed and the direction relay 208 will be actuated to drive the carriage assembly in the opposite direction transverse of the material. It will be understood that the frame for the second embodiment will be essentially the same as the frame for the first embodiment. The left and right limit switches 163 and 165 are essentially the same as the proximity limit switches shown in FIG. 2.

There has been provided by the present invention a unique cutting machine that incorporates a rotary cutting blade that frictionally cooperates with a stationary blade, the rotary cutting blade being canted in one direction during forward traverse of the rotary cutting blade along the stationary blade, and being canted in the opposite direction during reverse transverse movement of the cutting blade to effect cutting of material in both directions of operation.

While we have shown presently preferred embodiments of the present invention, it will be apparent to persons skilled in the art that the invention may be otherwise embodied within the scope of the following claims.

We claim:

1. A cutting machine for cutting material including long sheets, rolls or webs or the like, into sheet material of discrete lengths comprising a frame, a feed roll on said frame, a clamping mechanism cooperating with said feed roll for holding material to be cut, a stationary blade disposed tranversely on the frame, said clamping mechanism selectively holding the material to be cut against the stationary blade, a carriage movable on the frame, a drive mechanism operatively connected to the carriage for moving the carriage on the frame, the carriage including a base having a pivot extending therefrom, a block carried on the pivot, a movable blade carried rotatably on the block, a lever on the block, actuating means cooperating with the lever for selectively pivoting the block between a first position and a second position for positively canting the movable blade to a predetermined angle with respect to the stationary blade, said clamping mechanism comprising a transversely elongated body having a chamber therein and an elongated slot extending transversely and being adjacent to the stationary blade, suction means communicating with the chamber for supplying suction thereto to draw particles of cut material and dust into the chamber and remove them from the cutting region between the movable blade and the stationary blade, whereby, the movable blade is canted in one direction during forward traverse movement of the carriage and is canted in the opposite direction during reverse transverse movement of the carriage, thereby effecting cutting of material in both directions of operation with essentially only a single point of contact between the stationary blade and the movable blade.

2. A cutting machine as in claim 1, wherein the actuating means comprises a fluid cylinder operatively connected to the block for selectively pivoting same to selectively cant the movable blade with respect to the stationary blade.

3. A cutting machine as in claim 3, wherein the fluid cylinder is an air cylinder.

4. A cutting machine as in claim 1, including guide rail means on the frame for engaging with and guiding the carriage.

5. A cutting machine as in claim 1, wherein the drive mechanism for moving the carriage on the frame comprises a cog belt.

6. A cutting machine as in claim 1 including means for biasing the movable blade toward the stationary blade.

7. A cutting machine as in claim 1, wherein the movable blade is round and is rotatably carried on the block, and the angle of cant of the movable blade with respect to the stationary blade is on the order of 1 to 10 degrees.

8. A cutting machine as in claim 7, wherein the angle of cant is on the order of 3 degrees.

9. A cutting machine as in claim 1 including a limit switch at each side of the frame, each limit switch being in circuit with the drive mechanism for reversing the direction of the drive mechanism when the carriage reaches its traverse limit.

10. A cutting machine for cutting material including long sheets, rolls or webs or the like, into sheet material of discrete lengths comprising a frame, a feed roll on said frame, a clamping mechanism cooperating with said feed roll for holding material to be cut, a stationary blade disposed tranversely on the frame, a carriage movable on the frame, a drive mechanism operatively connected to the carriage for moving the carriage on the frame, the carriage including a base having a pivot extending therefrom, a block carried on the pivot, a movable blade carried rotatable on the block, a lever on the block, actuating means cooperating with the lever for selectively pivoting the block between a first position and a second position for positively canting the movable blade to a predetermined angle with respect to the stationary blade, said actuating means being constructed and arranged to selectively adjust the predetermined angle of cant between the movable blade and the stationary blade, whereby, the movable blade is canted in one direction during forward traverse movement of the carriage and is canted in the opposite direction during reverse transverse movement of the carriage, thereby effecting cutting of material in both directions of operation with essentially only a single point of contact between the stationary blade and the movable blade.

11. A cutting machine as in claim 10, wherein the actuating means comprises a fluid cylinder operatively connected to the block for selectively pivoting same to selectively cant the movable blade with respect to the stationary blade.

12. A cutting machine as in claim 10, including guide rail means on the frame for engaging with and guiding the carriage.

13. A cutting machine as in claim 10, wherein the drive mechanism for moving the carriage on the frame comprises a cog belt.

14. A cutting machine as in claim 10, wherein the clamping mechanism selectively holds the materials to be cut against the stationary blade.

15. A cutting machine as in claim 10, including means for biasing the movable blade toward the stationary blade.

16. A cutting machine as in claim 10, wherein the movable blade is round and is rotatably carried on the block and the angle of cant of the movable blade with respect to the stationary blade is on the order of 1–10 degrees.

17. A cutting machine as in claim 16, wherein the angle of cant is on the order of 3 degrees.

18. A cutting machine as in claim 10, including a limit switch at each side of the frame, each limit switch being in circuit with the drive mechanism for reversing the direction of the drive mechanism when the carriage reaches its traverse limit.

19. A cutting machine for cutting material including long sheets, rolls or webs or the like, into sheet material of discrete lengths comprising a frame, a feed roll on said frame, a clamping mechanism cooperating with said feed roll for holding material to be cut, a stationary blade disposed tranversely on the frame, a carriage movable on the frame, a drive mechanism operatively connected to the carriage for moving the carriage on the frame, the carriage including a base having a pivot extending therefrom, a block carried on the pivot, a movable blade carried rotatably on the block, a lever on the block, actuating means cooperating with the lever for selectively pivoting the block between a first position and a second position for positively canting the movable blade to a predetermined angle with respect to the stationary blade, and including adjustment means for selectively positioning the movable blade with respect to the stationary blade, whereby, the movable blade is canted in one direction during forward traverse movement of the carriage and is canted in the opposite direction during reverse transverse movement of the carriage, thereby effecting cutting of material in both directions of operation with essentially only a single point of contact between the stationary blade and the movable blade.

20. A cutting machine as in claim 19, wherein the adjustment means is disposed between the journal and the block for adjusting the position of the movable blade toward and away from the stationary blade both longitudinally and traversely.

21. A cutting machine as in claim 19, wherein the actuating means comprises a fluid cylinder operatively connected to the block for selectively pivoting same to selectively cant the movable blade with respect to the stationary blade.

22. A cutting machine as in claim 19, wherein the drive mechanism for moving the carriage on the frame comprises a cog belt.

23. A cutting machine as in claim 19, wherein the clamping mechanism holds the material to be cut.

24. A cutting machine as in claim 19, including means for biasing the movable blade toward the stationary blade.

25. A cutting machine as in claim 19, wherein the movable blade is round and is rotatably carried on the block and the angle of cant of the movable blade with respect to the stationary blade is on the order of 1–10 degrees.

26. A cutting machine as in claim 25, wherein the angle of cant is on the order of 3 degrees.

27. A cutting machine as in claim 19, including a limit switch at each side of the frame, each limit switch being in circuit with the drive mechanism for reversing the direction of the drive mechanism when the carriage reaches its traverse limit.

* * * * *